United States Patent [19]

Stermer

[11] Patent Number: 5,013,037

[45] Date of Patent: May 7, 1991

[54] PHYSICAL THERAPY DEVICE

[76] Inventor: Todd Stermer, 230 Amos, Portage, Mich. 49008

[21] Appl. No.: 605,960

[22] Filed: Oct. 30, 1990

[51] Int. Cl.[5] ..... A63B 21/02; A63B 23/00; A61H 1/02

[52] U.S. Cl. ..... 272/139; 272/93; 272/96; 272/135; 128/25 R; 128/80 C

[58] Field of Search ..... 272/93, 96, 116, 126, 272/135, 137, 139; 128/77, 80 R, 80 C, 80 G, 25 R, 25 B, 26; 623/27, 28, 39, 42, 59

[56] References Cited

U.S. PATENT DOCUMENTS

| | | | |
|---|---|---|---|
| 2,553,277 | 5/1951 | Robinson et al. | 128/26 |
| 4,844,454 | 7/1989 | Rogers | 272/126 |
| 4,856,500 | 8/1989 | Spademan | 128/80 C |
| 4,961,416 | 10/1990 | Moore et al. | 128/80 C |

FOREIGN PATENT DOCUMENTS

| | | | |
|---|---|---|---|
| 295632 | 10/1914 | Fed. Rep. of Germany | 272/139 |

OTHER PUBLICATIONS

*Functional Wrist Splint,* Von Werssowetz et al., The Jounal of Bone and Joint Surgery, Jan 1956, p. 224.

*Primary Examiner*—Richard J. Apley
*Assistant Examiner*—Karen G. Horowitz
*Attorney, Agent, or Firm*—Flynn, Thiel, Boutell & Tanis

[57] ABSTRACT

A physical therapy device is disclosed which is used in the rehabilitation of the limb of a user. The physical therapy device is attached to the limb of the user and the position of the biasing member can be changed between a first position and a second position directly opposed to the first position, thereby providing a resistive force against which different muscles of the limb work against.

8 Claims, 2 Drawing Sheets

PHYSICAL THERAPY DEVICE

FIELD OF THE INVENTION

This invention pertains to the rehabilitation of an injured limb of a human being and, in particular, to the rehabilitation of an injured arm or leg by applying a force that serves to extend or contract the injured arm or leg.

BACKGROUND OF THE INVENTION

Following reconstructive surgery to repair an injured arm or leg, the patient is typically faced with the long, arduous and often expensive task of rehabilitating the injured limb.

For example, the typical purpose of reconstructive surgery to the knee is to return stability to the knee and leg. In doing so, the muscles, tendons and ligaments surrounding the knee are either appreciably shortened or tightened by the surgeon to return stability to the knee by holding the knee joint firmly in place, or through atrophy of the injured and surrounding muscles, tendons and ligaments from inactivity during recovery. A typical rehabilitation program following knee surgery has the objective of stretching and strengthening the muscles, tendons and ligaments of the knee and leg. In order to effectively accomplish this objective, the recovering patient must have access to expensive and complicated rehabilitative devices.

However, many people do not have insurance coverage which affords the opportunity to have access to the expensive rehabilitation programs which are necessary to regain complete and uninhibited use of the injured knee and leg. Even people who have insurance which partially covers the treatment of these types of injuries, usually face out-of-pocket expenses, such as the cost of medication, leg braces or professional help.

As a consequence of these burdens, one of the most important steps for adeqate recovery of the injured knee, physical therapy, is usually missed or performed improperly, which leaves the knee and leg weak and unstable and makes them more susceptible to reinjury. Therefore, there is a need for a method of rehabilitating a limb following surgery which is less expensive and more convenient than the methods that are currently available.

Accordingly, it is a primary object of the present invention to provide a portable physical therapy system which accomplishes the rehabilitation of an injured limb by applying a resistive force about the major joint of the limb which serves to stretch or constrict the injured limb.

It is a further object of the present invention to provide a portable physical therapy system which strengthens the lower leg of a user by providing a resistive force against which the lower leg muscles work against through the flexing of the user's foot.

SUMMARY OF THE INVENTION

The foregoing and other objects, advantages and features of the present invention are achieved through a physical therapy device comprising means for biasing a limb of a user into either a stretched or contracted position, the biasing means being pivotable between a first position and a second position opposed to the first position; means for supporting said biasing means in the first position; means for supporting said biasing means in the second position opposed to the first position; and means for attaching the supporting means to the limb of the user.

Additionally, a sling unit can be attached to the biasing means and brought into engagement with the ball and toe area of the user's foot. In this configuration, the biasing means pulls the toes back, thereby stretching the ligaments, tendons and muscles in the user's lower leg. By flexing or extending the foot away from the biasing means, the lower leg muscles, particularly the calf muscles, are strengthened.

DETAILED DESCRIPTION OF THE PREFERRED EMBODIMENTS

Figure 2:
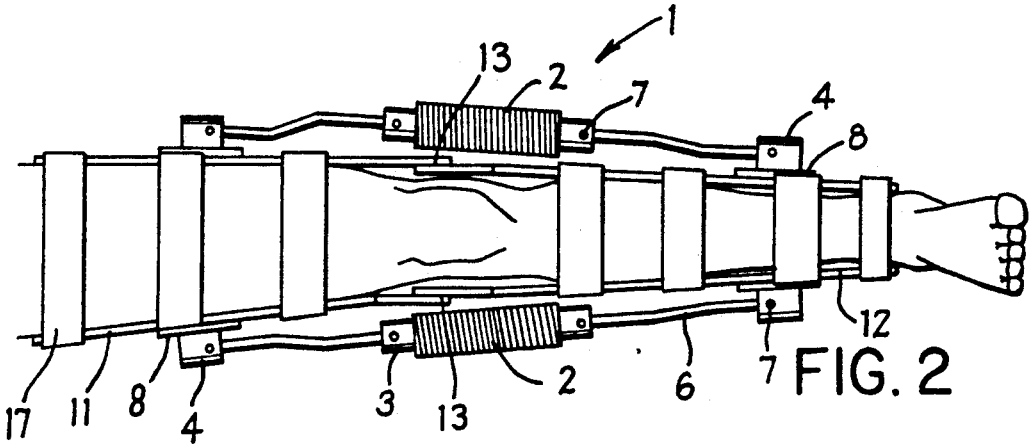
FIG. 2 is a top view of the physical therapy device of the present invention attached to the extended leg of the user.

Referring to FIG. 2, there is shown a physical therapy device 1 according to the present invention. The physical therapy device 1 comprises biasing members 2, such as springs, provided on opposite sides of the user's limb directly adjacent the major joint of the limb such as a knee or elbow. Other biasing members 2 which resist being bent during the flexing of the limb can be used.

The biasing members 2 have a first set of straight couplers 3 provided at opposite ends thereof. The straight couplers 3 preferably have a cylindrical configuration and are fixedly secured to the ends of the biasing means 2 by adhesives, welding or any other suitable method of attachment, depending on the materials of construction of the biasing members 2 and the straight couplers 3. The straight couplers 3 have axial, longitudinally extending openings provided therein in which a first end of the connector rods 6 is received. Additionally, tightening screws 7 are contained in a second opening provided in an outer surface of the straight couplers which extends orthogonally to the longitudinally extending opening. By bringing the tightening screws 7 into engagement with the first end of the connector rods 6, the connector rods 6 can be secured nonrotatably inside the straight couplers 3.

A second set of straight couplers 4 is positioned along the limb of the user so as to be capable of receiving the other end of the connector rods 6 in axial, longitudinally extending openings provided therein. The second set of couplers 4 also preferably are of cylindrical configuration and may be identical to or different from the first set of couplers 3 with respect to length and width. The axis of the longitudinally extending opening provided in the second couplers 4 is located a distance from the longitudinally extending axis of the longitudinally extending opening provided in the first couplers 3 equal to the height of a bend 9 provided between straight portions of the connector rods 6. The straight portions of the connector rods 6 joined by the bend 9 are parallel to each other.

Figure 1:
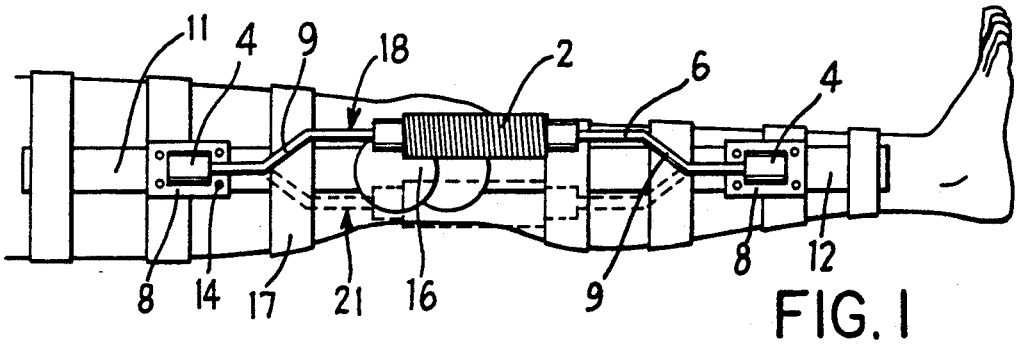
FIG. 1 is a side view of the physical therapy device of the present invention attached to the extended leg of the user.

Tightening screws 7 are also contained in a second opening provided in the outer surface of the second set of couplers 4 which extends orthogonally to the axial, longitudinally extending openings provided in the second couplers 4. As shown in FIG. 1, when the tightening screws 7 are not in contact with the second end of the connector rods 6, the biasing members 2 are free to swivel between an upper position 18 and a lower position 21 with respect to the straight couplers 4. By bringing the tightening screws 7 into engagement with the second end of the support rods 6, the biasing members 2 can be locked into either the upper position 18 or the lower position 21.

The straight couplers 4 are fixedly secured to coupler bases 8 by an adhesive or welding or any other suitable means, depending on the material of construction of the straight couplers 4 and the coupler bases 8. The coupler bases 8 preferably have a rectangular plate-type configuration, but may be provided in other shapes if desired. The coupler bases 8 may be attached to upper and lower struts 11, 12 by a securing means such as rivets 14 or attached directly to the user's limb when struts 11, 12 are not used.

The upper struts 11 and lower struts 12 are elongated strips of a fairly rigid material which meet at joints 13 directly adjacent to the major joint of the limb, such as a knee or elbow. The adjacent ends of the upper struts 11 and the lower struts 12 are rotatably connected to each other by either pins (not shown) or a mechanical hinge 16 which restricts the lateral movement of the struts.

Attachment straps 17 are provided along the length of the upper and lower struts 11, 12 and encircle the struts and the limb of the user to secure the physical therapy device 1 to the limb. The straps can be made of any suitable material, such as a natural or synthetic fabric, and each strap 17 may fasten by use of mating hook and loop material such as that known under the trademark Velcro® surfaces or a buckle.

Figure 3:
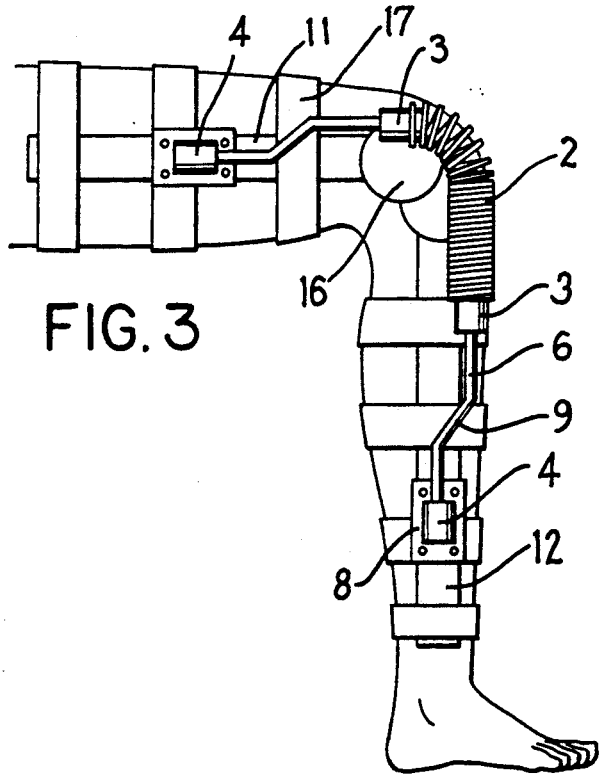
FIG. 3 is a side view of the physical therapy device of the present invention attached to the bent leg of the user.

The physical therapy device 1 of the present invention is placed on the user's limb and attached thereto so that the biasing members 2 are located directly adjacent to the major joint of the limb such as a knee or elbow. When the physical therapy device 1 is secured to the limb of the user, the biasing members 2 are placed into either the upper position 18 or the lower position 21 and locked in this position by use of tightening screws 7. As shown in FIGS. 1 through 3, when the biasing members 2 are placed in the upper position 18 and attached to the leg of a user, the user's hamstrings and adductor magnus muscles will be exercised by the user bending his leg against the resistive force of the biasing members 2.

By loosening the tightening screws 7 in the couplers 4 and allowing the biasing members 2 to swivel to the lower position 21 shown in FIG. 1, the physical therapy device of the present invention can be used to oppose extension of the user's leg, thereby exercising the quadracep muscles and stretching the knee ligaments and tendons to a fully flexed position. When the device 1 is used in this lowered position 21, the leg is slightly bent at the knee at the commencement of use so that the biasing members 2 are under no tension. Therefore, when springs are used as the biasing members 2, a shorter length of springs is generally used when the springs are positioned at the lower position 21 in order to effectively exercise the limb. The shorter the length of the biasing members 2, the greater the bend that is required in the leg at the commencement of exercise and the greater the distance the leg must work against the biasing members 2 in becoming fully extended.

The biasing members 2 can be easily removed from the connector rods 6 by loosening the tightening screws 7 provided in the couplers 3 provided at the ends of the biasing members until the biasing members can be removed therefrom. Biasing means, having different lengths and different degrees of resistive force or stiffness, can be installed onto the connector rods 6 simply by placing the first end of the connector rods 6 into the longitudinally extending openings provided in the couplers 3 and bringing the tightening screws 7 into engagement with the first ends of the connecting rods 6.

Figure 4:
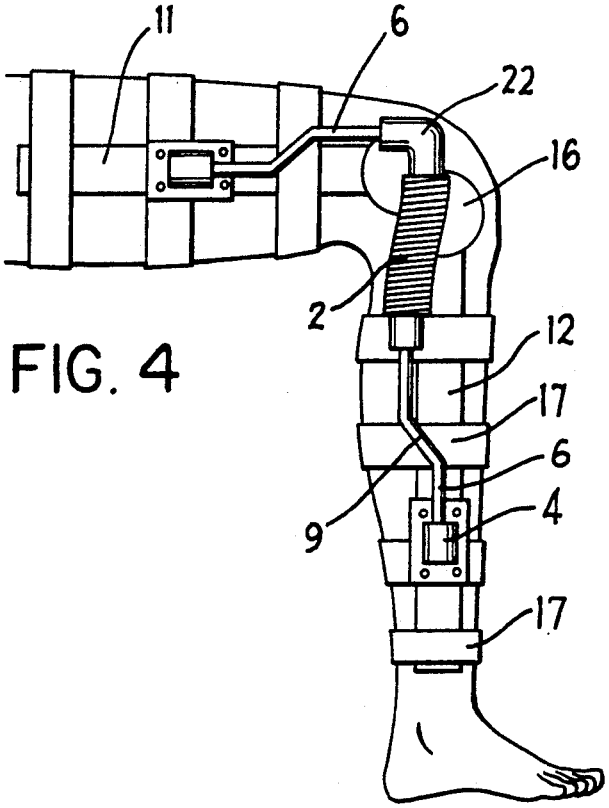
FIG. 4 is a side view of a second embodiment of the present invention attached to the bent leg of the user.
Figure 5:
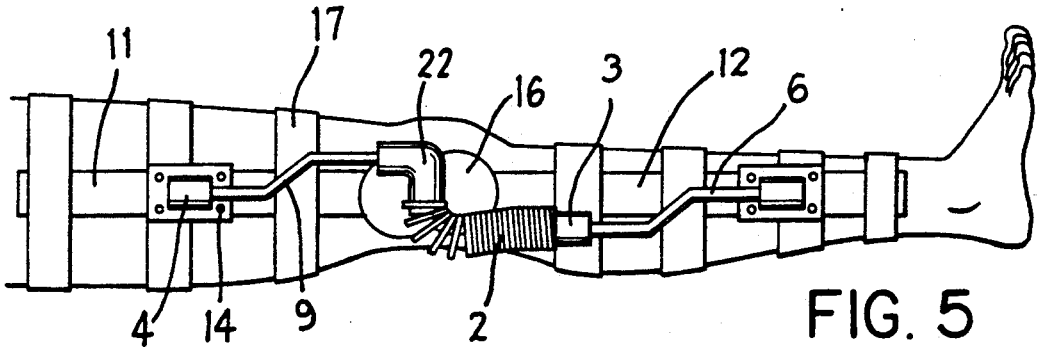
FIG. 5 is a side view of a second embodiment of the present invention attached to the extended leg of the user.

As shown in FIGS. 4 and 5, elbow couplers 22 can be used to replace the couplers 3 provided at an end of the biasing members 2. When the connector rods 6 are positioned as shown in FIGS. 4 and 5, the biasing members 2 biases the leg against extension and thereby functions identically to the biasing member 2 at the lower position 21 shown in FIG. 1. By reversing the positions of the connector rods 6 in FIGS. 4 and 5, the physical therapy device of the present invention will bias against flexing of the leg and thereby function similarly to the physical therapy device as shown in FIGS. 1 through 3 with the biasing members 2 placed at the upper position 18.

Figure 6:
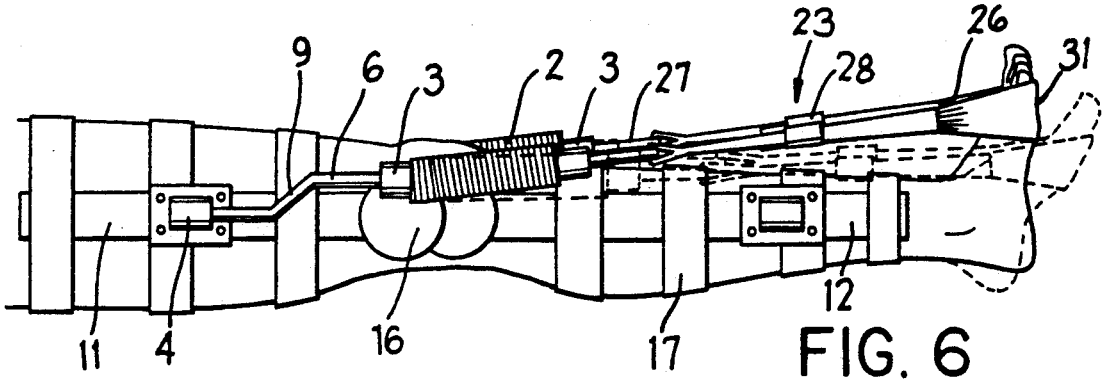
FIG. 6 is a side view of a third embodiment of the present invention in which a sling unit is provided therewith.

In another embodiment of the present invention as shown in FIG. 6, the connector rods 6 positioned adjacent the lower strut 12, are removed and replaced by a sling unit 23. The sling unit 23 comprises a pair of sling connector rods 27 having a sling member 26 attached to adjacent ends thereof. The other ends of the sling connector rods 27 are inserted into the longitudinally extending openings provided in the couplers 3 and secured therein by tightening screws 7. The sling 26 has a padded area 31 which is brought into engagement with the user's toes and ball of his foot. Adjustable slides 28 are then used to adjust the length of the sling 26. When the sling 26 is adjusted to a proper length, the user may exercise the calf muscles of the leg by flexing or stretching the toe and foot area away from the biasing members 2. Alternatively, the ligaments, tendons and muscles in the lower leg can be stretched by slowly flexing the toe and foot area back toward the biasing members 2.

The materials of construction of the connector rods 6, couplers 3, 4, 22, struts 11, 12, coupler bases 8 and biasing members 2 can be of any suitable material, such as a plastic, metal or hard rubber. Additionally, the physical therapy device of the present invention can function without the struts 11, 12 by simply fastening the coupler bases 8 directly to the limb of the user by the attachment straps 17. The coupler bases 8 can also be attached directly to struts of a conventional knee brace by clips, rivets or other securing means, thereby allowing the physical therapy device of the present invention to be used therewith.

It is understood that the above-described arrangements are merely illustrative of many possible specific embodiments which represent the present invention. Numerous and varied other arrangements can be readily devised without departing from the spirit and scope of the present invention.

The embodiments of the invention in which an exclusive property or privilege is claimed are defined as follows:

1. A physical therapy device comprising:

means for biasing a limb of a user to an extended or contracted position;

means for supporting said biasing means lying along an imaginary longitudinal axis down the user's leg;

means for attaching said supporting means to the limb of the user;

said biasing means being offset from said imaginary longitudinal axis and further being rotatably connected to said support means so that said biasing means can be swivelled between a first position and a second position opposed to said first position;

whereby said supporting means supports said biasing means in one of said positions to bias said limb to be extended and furthermore supports said biasing means in the other of said positions to bias said limb against being extended.

2. The physical therapy device of claim 1, wherein said biasing means comprises spring elements and rod members.

3. The physical therapy device of claim 2, wherein one end of said rod members is contained within an opening provided in said supporting means and the other end of said rod members is attached to said spring elements.

4. The physical therapy device of claim 3, additionally comprising setscrews set in said supporting means for engaging with said rod means when said biasing means is in said first position and thereby locking said biasing means in said first position.

5. The physical therapy device of claim 3, additionally comprising setscrews set in said supporting means for engaging said rod means when said biasing means is in said second position and thereby locking said biasing means in said second position.

6. The physical therapy device of claim 1, additionally comprising a sling member, said sling member having a cup portion for engagement with the user's foot and rod portions which are attached to said biasing means.

7. The physical therapy device of claim 1, wherein said attaching means comprises a plurality of straps.

8. The physical therapy device of claim 1, additionally comprising means for preventing lateral movement of said limb.

* * * * *

UNITED STATES PATENT AND TRADEMARK OFFICE

CERTIFICATE OF CORRECTION

PATENT NO. : 5 013 037

DATED : May 7, 1991

INVENTOR(S) : Todd STERMER

It is certified that error appears in the above-identified patent and that said Letters Patent is hereby corrected as shown below:

Column 6, line 11; after "engaging" insert ---with---.

Signed and Sealed this

Second Day of March, 1993

*Attest:*

STEPHEN G. KUNIN

*Attesting Officer*

*Acting Commissioner of Patents and Trademarks*